US007731333B2

(12) United States Patent
Honma et al.

(10) Patent No.: US 7,731,333 B2
(45) Date of Patent: Jun. 8, 2010

(54) LIQUID-JET HEAD AND LIQUID-JET APPARATUS

(75) Inventors: Hiroki Honma, Shiojiri (JP); Kazutoshi Goto, Matsumoto (JP); Isao Yanagisawa, Chino (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 818 days.

(21) Appl. No.: 11/653,118

(22) Filed: Jan. 12, 2007

(65) Prior Publication Data

US 2007/0165070 A1 Jul. 19, 2007

(30) Foreign Application Priority Data

Jan. 19, 2006 (JP) ..... 2006-011630
Dec. 20, 2006 (JP) ..... 2006-343584

(51) Int. Cl.
*B41J 2/14* (2006.01)
*B41J 2/16* (2006.01)

(52) U.S. Cl. ..... 347/47; 347/29

(58) Field of Classification Search ..... 347/29, 347/47, 67

See application file for complete search history.

(56) References Cited

U.S. PATENT DOCUMENTS 6,729,717 B2 5/2004 Ito et al.
7,063,405 B2 6/2006 Ito et al.
7,484,828 B2 2/2009 Owaki
2006/0001713 A1 * 1/2006 Kwan et al. ..... 347/86

FOREIGN PATENT DOCUMENTS

CN 1590099 A 3/2005
JP 2001-293860 10/2001
JP 2002-144590 A 5/2002
JP 2005-096419 4/2005

* cited by examiner

*Primary Examiner*—Thinh H Nguyen
(74) *Attorney, Agent, or Firm*—Nutter McClennen & Fish LLP; John J. Penny, Jr.

(57) ABSTRACT

A liquid-jet head includes: a plurality of head bodies, each having: a nozzle plate having a plurality of nozzles bored therein; a passage-forming substrate having a pressure generating chamber formed therein, which communicates with the nozzle and receives a pressure for use in ejecting a liquid droplet from a pressure generating element; and a head case disposed on the passage-forming substrate at a surface opposite to the nozzle plate and having paths for supplying liquid to the pressure generating chamber therethrough; and a fixing member bonded onto a side of the nozzle plate of each of the plurality of head bodies, to positionally fix the head bodies thereto at predetermined intervals, wherein a reinforcing portion made of a predetermined adhesive agent, which is charged in a clearance between the head bodies fixed to the fixing member, followed by setting, is disposed at the clearance.

13 Claims, 13 Drawing Sheets

LIQUID-JET HEAD AND LIQUID-JET APPARATUS

The entire disclosure of Japanese Patent Applications Nos. 2006-11630 filed Jan. 19, 2006 and 2006-343584 filed Dec. 20, 2006 is expressly incorporated by reference herein.

BACKGROUND

1. Technical Field

The present invention relates to a liquid-jet head and a liquid-jet apparatus which jet a liquid droplet from a nozzle bored at a nozzle plate. In particular, the invention relates to an ink-jet recording head and an ink-jet recording apparatus, in which an ink droplet is ejected from a nozzle in accordance with an amount of displacement of a piezoelectric element mounted on a vibration plate constituting a part of a pressure generating chamber communicating with the nozzle.

2. Related Art

There has been conventionally known a liquid-jet head which ejects a liquid droplet from a nozzle by applying a pressure to liquid by a piezoelectric element or a pressure generator such as a heat generating element. Atypical example of the liquid-jet head includes an ink-jet recording head which ejects an ink droplet. Such an ink-jet recording head, that is, an ink-jet recording unit is disclosed in, for example, JP-A-2005-096419. In the ink-jet recording unit, a head body is constituted by joining a nozzle plate or the like having a nozzle orifice bored therein with a passage-forming substrate having a pressure generating chamber formed therein. The plurality of head bodies are adhesively secured to a fixing plate (a fixing member), and further, are covered with a head case.

Moreover, an ink-jet recording apparatus on which the ink-jet recording head is mounted is disclosed in, for example, JP-A-2001-293860. The apparatus is provided with a capping member for sealing a nozzle surface at which the nozzle bored at the ink-jet recording head is opened, so that the nozzle can be prevented from being clogged by a sucking operation for sucking the inside of the capping member so as to forcibly discharge a viscously increased ink in the state that the nozzle surface of the ink-jet recording head is sealed with the capping member.

SUMMARY

As described above, the plurality of head bodies are secured at predetermined intervals to the fixing plate in the ink-jet recording head. In other words, a clearance is defined between the head bodies secured to the fixing plate. As a consequence, when the capping member abuts against an ink ejection surface in the ink-jet recording head, the fixing plate is deformed (curved), thereby inducing a possibility of misalignment of the nozzles. Here, if the nozzles are misaligned, the landing accuracy of an ink droplet is deteriorated, thereby raising a problem of degradation of a print quality.

The above-described problem has risen in not only the ink-jet recording head but also other liquid-jet heads for ejecting liquid other than ink.

An advantage of some aspects of the invention is to provide a liquid-jet head and a liquid-jet apparatus, in which the positional landing accuracy of a liquid droplet can be satisfactorily maintained for a long period of time by preventing any deformation of a fixing member.

A liquid-jet head includes: a plurality of head bodies, each having: a nozzle plate having a plurality of nozzles bored therein; a passage-forming substrate having a pressure generating chamber formed therein, which communicates with the nozzle and receives a pressure for use in ejecting a liquid droplet from a pressure generating element; and a head case disposed on the passage-forming substrate at a surface opposite to the nozzle plate and having paths for supplying liquid to the pressure generating chamber therethrough; and a fixing member bonded onto a side of the nozzle plate of each of the plurality of head bodies, to positionally fix the head bodies thereto at predetermined intervals, wherein a reinforcing portion made of a predetermined adhesive agent, which is charged in a clearance between the head bodies fixed to the fixing member, followed by setting, is disposed at the clearance.

According to an aspect of the invention, the rigidity of the fixing member can be substantially enhanced by the reinforcing portion, so that the fixing member can be prevented from being deformed even if, for example, the capping member or the like abuts against the nozzle surface to which the nozzles are opened. As a consequence, the nozzles are never misaligned, thus satisfactorily maintaining the positional landing accuracy of the liquid droplet for a long period of time.

Here, it is preferable that the head body should be positionally fixed onto a bottom side of a recess portion formed in the fixing member, the adhesive agent should be charged in a clearance defined between a side wall of the recess portion and the head body, and the reinforcing portion should be disposed also at a circumferential edge of the fixing member. Consequently, the rigidity of the fixing member can be more securely enhanced.

It is preferable that the reinforcing portion should be made of an adhesive agent having a lower viscosity in an unset state and a lower hardness in a set state than those of the adhesive agent for use in bonding the fixing member and the head body to each other. In this manner, the reinforcing portion can be satisfactorily formed, and further, the fixing member can be prevented from being deformed due to setting contraction of the adhesive agent constituting the reinforcing portion.

Furthermore, the reinforcing portion may be constituted of a plurality of layers made of adhesive agents different from one another. In this case, it is preferable that the hardness of the adhesive agent constituting each of the layers in a set state should become higher toward the fixing member. As a consequence, the deformation of the fixing member can be prevented by substantially enhancing the rigidity of the fixing member, and at the same time, the fixing member can be more securely prevented from being deformed due to the setting contraction of the adhesive agent constituting the reinforcing portion.

Moreover, the reinforcing portion may be constituted of a first layer formed on the side of the fixing member and a second layer formed on the first layer and made of an adhesive agent having a higher hardness in a set state than the adhesive agent constituting the first layer. In this case, it is preferable that the first layer should be thinner than the second layer. Consequently, it is possible to prevent any deformation of the fixing plate caused by the abutment of the capping member or the like, and further, to prevent any deformation of the fixing plate accompanied with the setting contraction of the adhesive agent constituting the reinforcing portion.

Additionally, the reinforcing portion may be constituted of a first layer formed on the side of the fixing member and a second layer formed on the first layer and made of an adhesive agent having a higher hardness in a set state than the adhesive agent constituting the first layer. In this case, preferably, the first layer is formed in such a thickness as not to be brought into contact with the head case. In this manner, it is possible to prevent any deformation of the fixing plate caused by the abutment of the capping member or the like, and further, to more securely prevent any deformation of the fixing plate accompanied with the setting contraction of the adhesive agent constituting the reinforcing portion.

In addition, it is preferable that the hardness of the reinforcing portion disposed at the clearance defined between the head bodies should be lower than that of the reinforcing portion disposed at the circumferential edge of the fixing member. As a consequence, the deformation of the fixing member can be prevented by substantially enhancing the rigidity of the fixing member, and at the same time, the fixing member can be more securely prevented from being deformed due to the setting contraction of the adhesive agent constituting the reinforcing portion.

Furthermore, the reinforcing portion disposed at the clearance defined between the head bodies may be constituted of a first layer formed on the side of the fixing member and a second layer formed on the first layer and made of an adhesive agent having a higher hardness in a set state than the adhesive agent constituting the first layer, and further, the reinforcing portion disposed at the circumferential edge of the fixing member may be constituted of only the first layer. This makes it possible to more securely prevent any deformation of the fixing plate caused by the abutment of the capping member or the like, and further, to prevent any deformation of the fixing plate accompanied with the setting contraction of the adhesive agent constituting the reinforcing portion.

Moreover, a liquid-jet head further may include a joining member, which joins each of the plurality of head bodies thereto and is formed integrally with a plurality of paths corresponding to the head bodies, respectively, on the side of the head case in each of the head bodies. In this case, it is preferable that the recess portion formed in the fixing member should have a depth reaching the joining member at the tip of the side wall. In this manner, the deformation of the fixing member can be restricted by the effect of the abutment of the side wall against the joining member.

Additionally, a pair of cutout portions for exposing a part of each of both ends of the head body may be formed on the side wall of the fixing member in a manner corresponding to each of the head bodies. This allows a part of the head body to be exposed from the cutout portion in the state that the head bodies are mounted on the fixing member. Thus, the cutout portion holds and moves the head body, so that the head body can be positionally adjusted with respect to the fixing member. As a result, the head body can be positionally fixed with respect to the fixing member with a high degree of accuracy.

In addition, a relief groove may be formed in the passage-forming substrate at a region outside of the pressure generating chamber, and the relief groove may communicate at one end thereof with the outside via a communicating portion opened at a side surface of the passage-forming substrate. In this case, it is preferable that an opening formed at the communicating portion should be sealed with a sealing member made of an adhesive agent having a lower viscosity in an unset state and a lower hardness in a set state than those of the adhesive agent constituting the reinforcing portion. Consequently, the sealing member can satisfactorily seal the opening of the communicating portion, and the adhesive agent is introduced into the relief groove via the communicating portion, thus preventing any cracks of the passage-forming substrate caused by the setting of the adhesive agent.

Furthermore, a liquid-jet head may further include a cover head disposed in such a manner as to cover the nozzle surface to which the nozzles of the head bodies fixed to the fixing member are opened. In this case, it is preferable that the fixing member should be a fixing plate interposed between the head body and the cover head. As a consequence, the rigidity of the fixing plate can be substantially enhanced by the reinforcing portion.

According to another aspect of the invention, a liquid-jet apparatus includes the liquid-jet head according to each of the above-described aspects. This makes it possible to implement a liquid-jet apparatus having enhanced durability and reliability of the head.

DESCRIPTION OF EXEMPLARY EMBODIMENTS

The invention will be described in detail below by way of preferred embodiments.

First Embodiment

Figure 1:
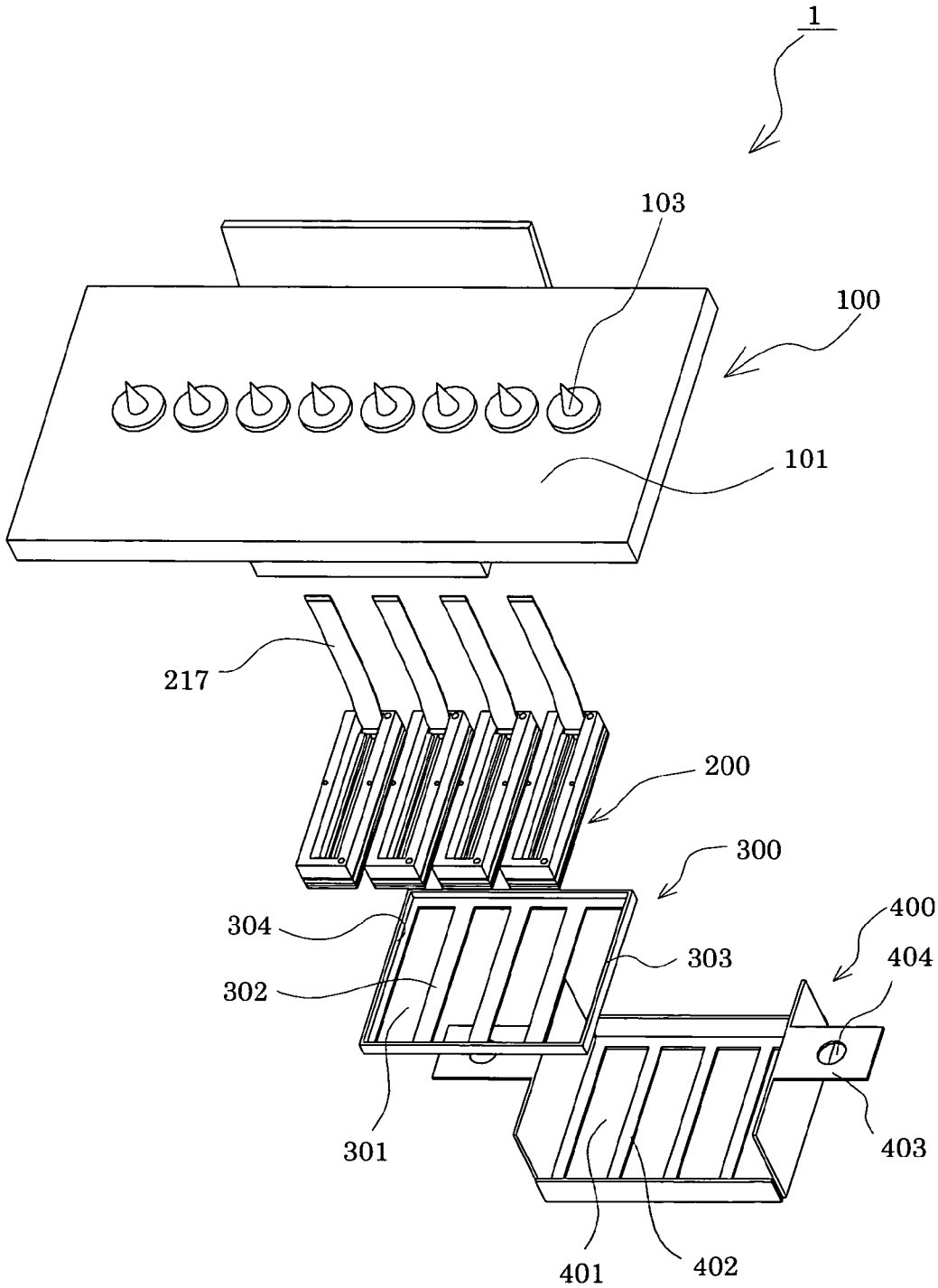
FIG. 1 is an exploded perspective view showing a recording head according to a first embodiment.
Figure 2:
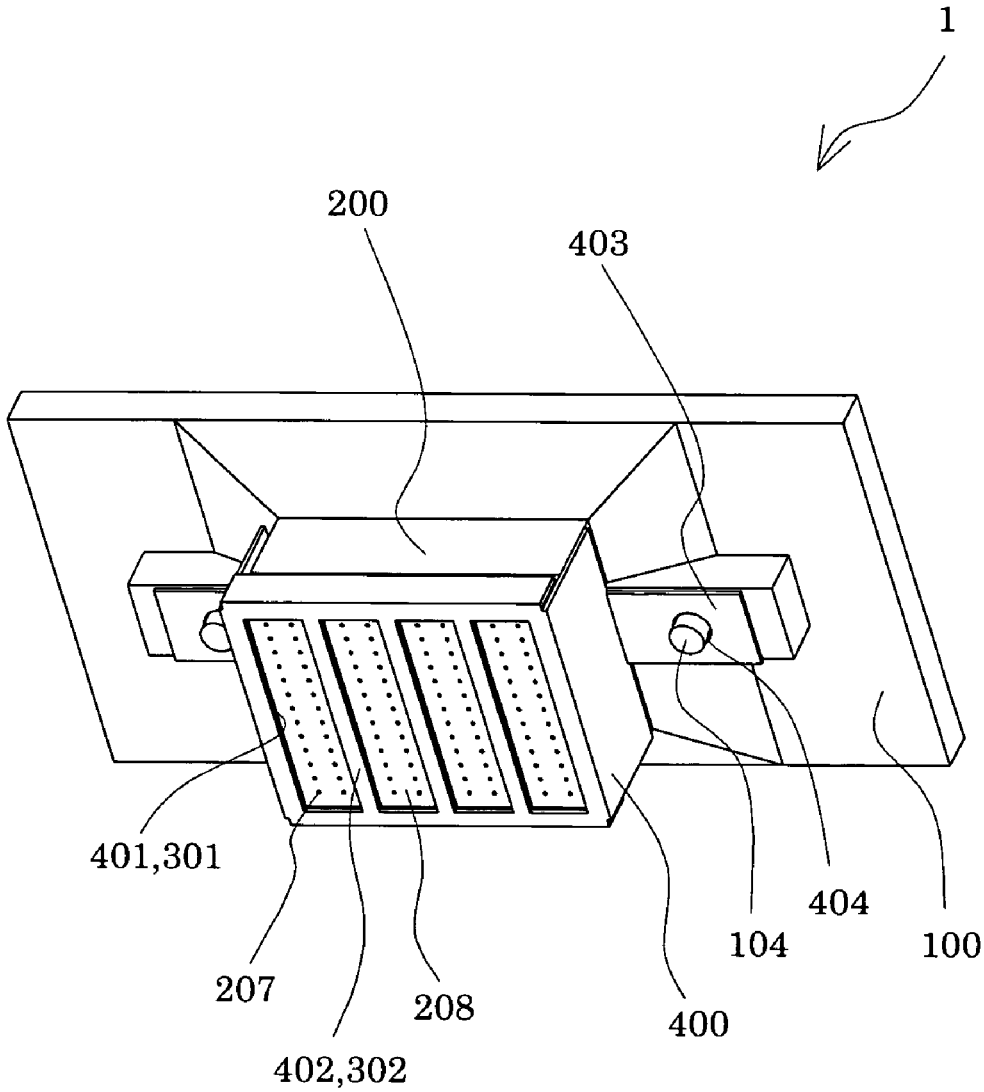
FIG. 2 is an assembled perspective view showing the recording head according to the first embodiment.

FIG. 1 is an exploded perspective view showing an ink-jet recording head according to a first embodiment according to the invention; FIG. 2 is an assembled perspective view showing the ink-jet recording head; and FIG. 3 is a cross-sectional view showing essential parts of the ink-jet recording head.

Figure 3:
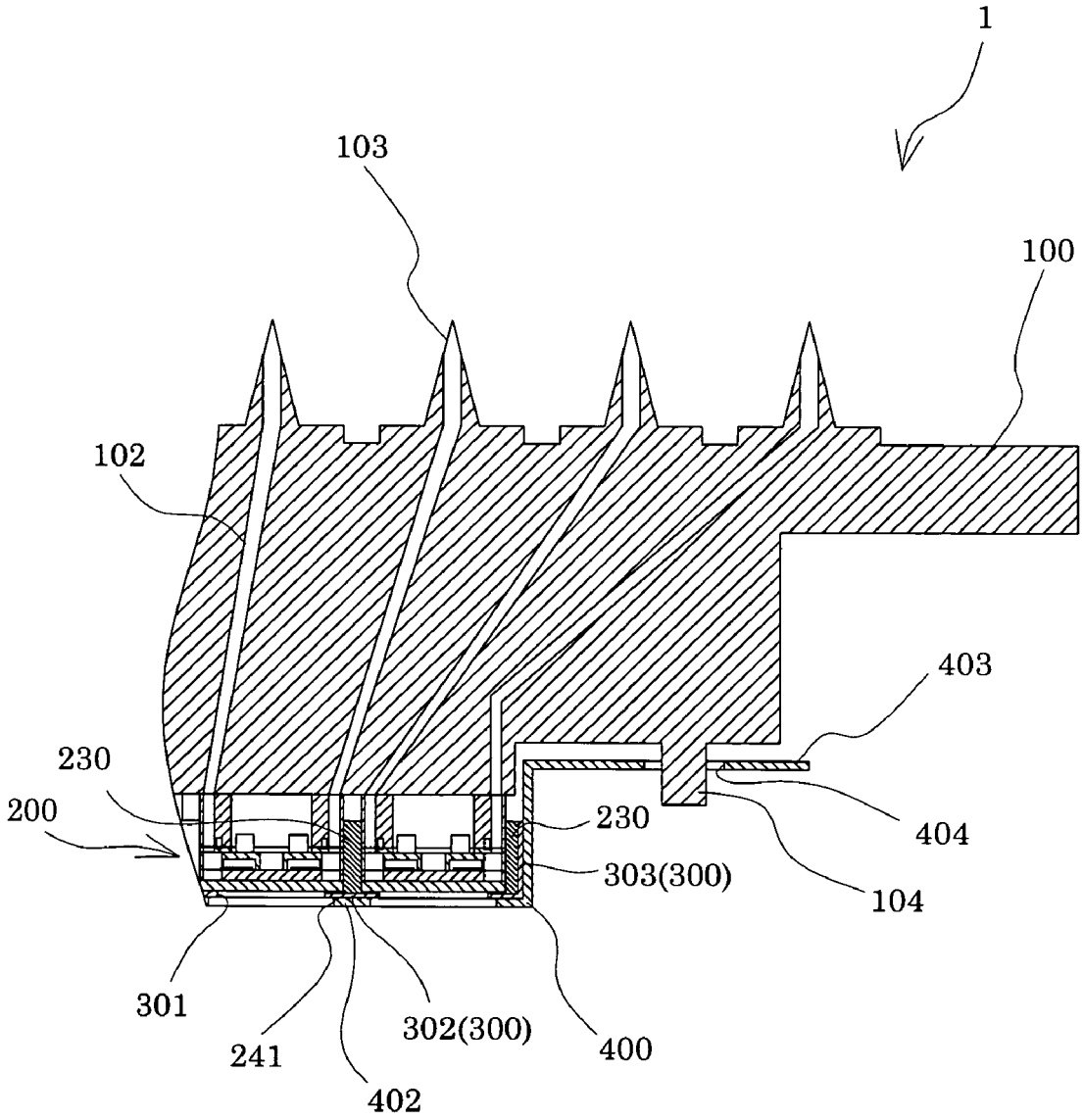
FIG. 3 is a cross-sectional view showing essential parts of the recording head according to the first embodiment.

An ink-jet recording head 1 (hereinafter simply referred to as "recording head") shown in FIGS. 1 to 3 is constituted of a cartridge case 100 serving as a joining member; ink-jet recording head bodies 200 (hereinafter simply referred to as "recording head bodies"); a fixing plate 300 serving as a fixing member which is bonded to a nozzle plate 208 so as to positionally fix the plurality of recording head bodies 200 thereto; and a cover head 400. The cartridge case 100 is made of, for example, a resin material, and includes a cartridge disposing portion 101 on which ink cartridges (not shown) serving as ink suppliers (liquid suppliers) are disposed. Formed at the bottom of the cartridge case 100 are a plurality of ink communicating paths 102, each of which is opened at one end thereof to the cartridge disposing port ion 101 while is opened at the other end thereof toward the recording head body 200. Furthermore, an ink supply needle 103 to be inserted into the ink cartridge is secured to an opening portion of the ink communicating path 102 in the cartridge disposing portion 101.

The plurality of recording head bodies 200 (which are four in the present embodiment) positioned at predetermined intervals are fixed at the bottom of the cartridge case 100, thereby constituting the recording head 1. The recording head bodies 200 in the recording head 1 are disposed in a manner corresponding to ink colors, respectively. The recording head bodies 200 are adhesively secured to the fixing plate 300, to be thus positioned with respect to one another. The recording head bodies 200 are fixed at the bottom of the cartridge case 100 in the positioned state, as described above.

Figure 4:
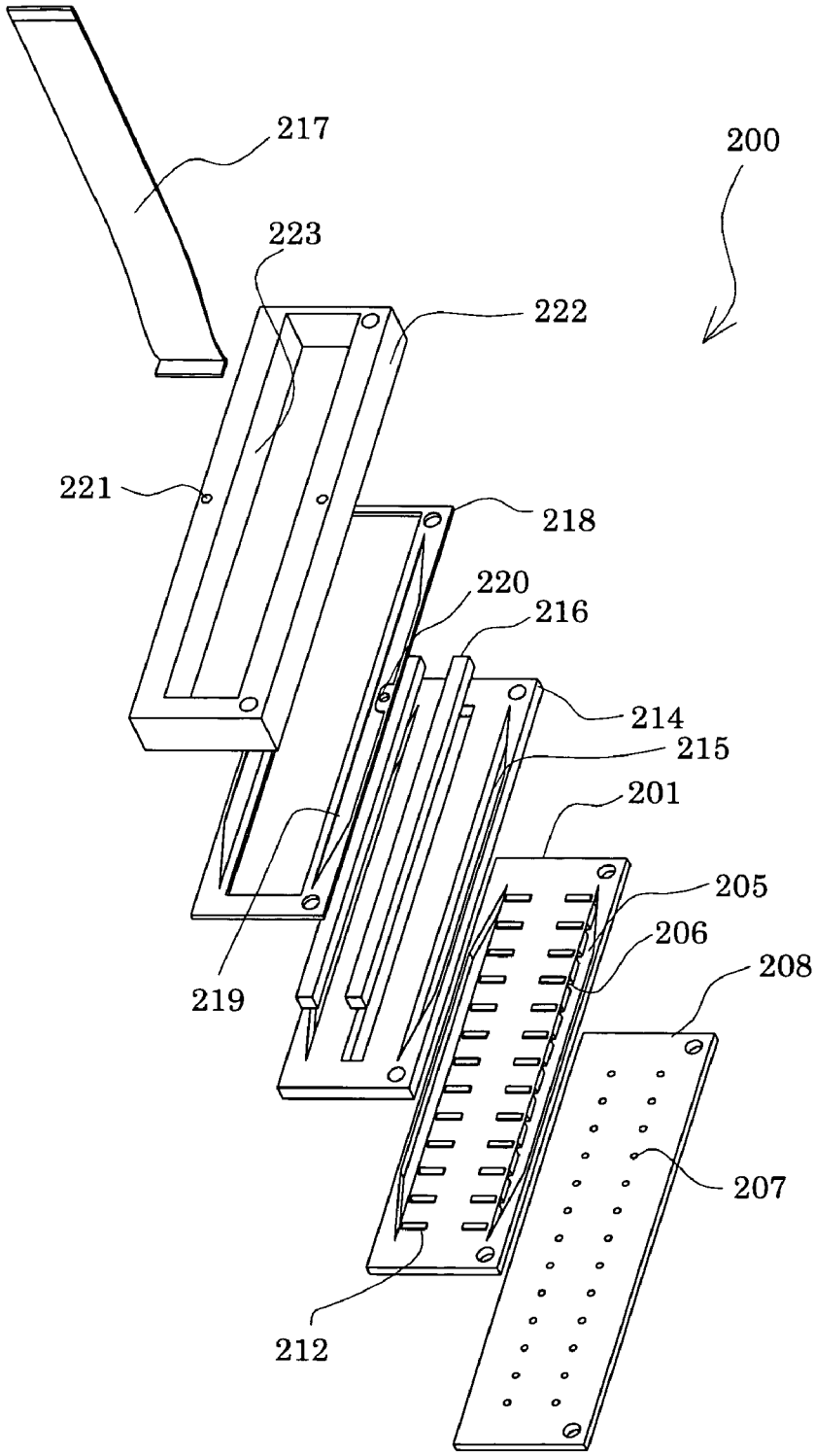
FIG. 4 is an exploded perspective view showing a recording head body according to the first embodiment.
Figure 5:
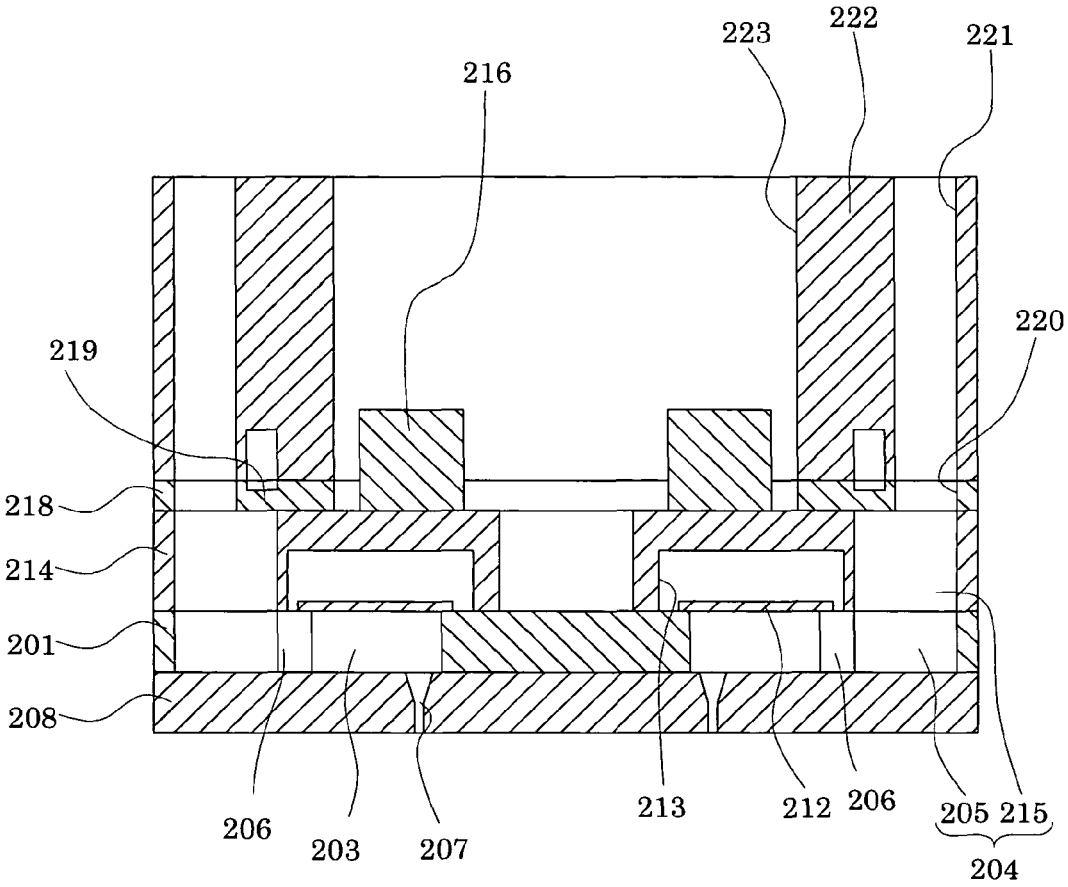
FIG. 5 is a cross-sectional view showing the recording head body according to the first embodiment.
Figure 6:
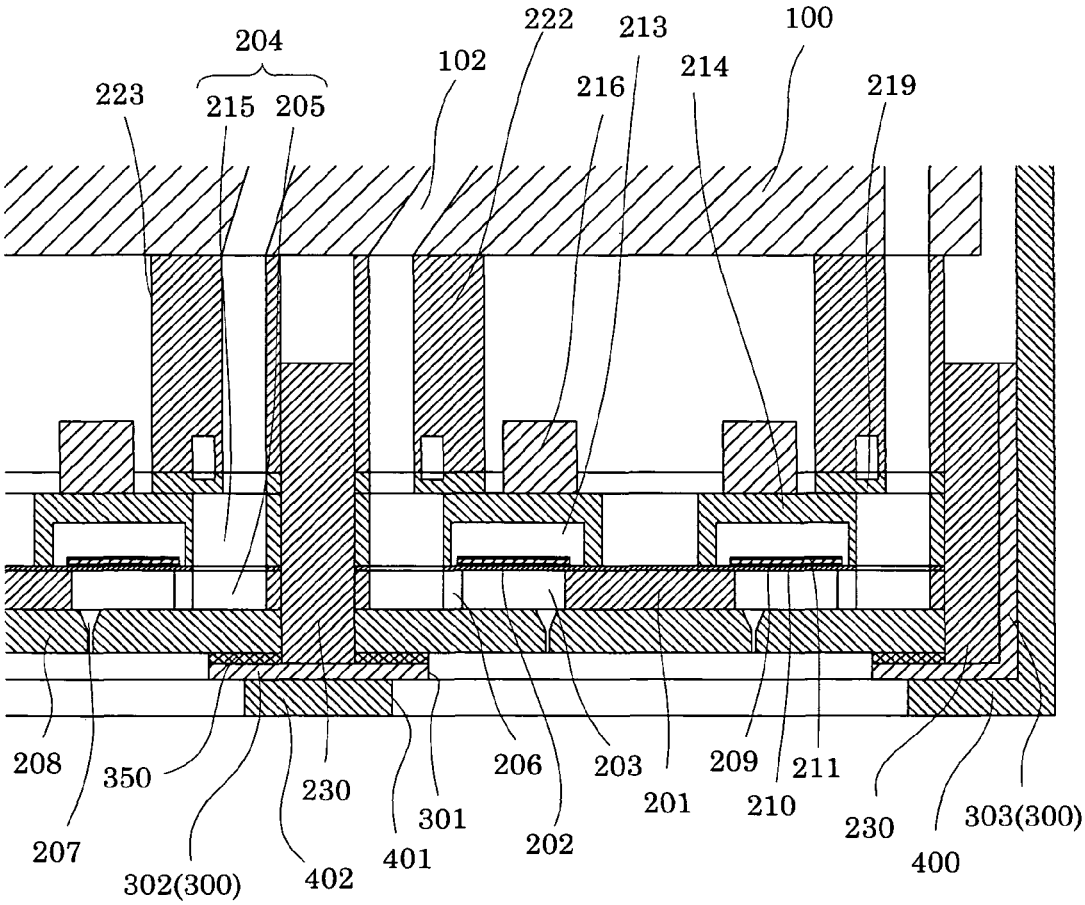
FIG. 6 is a cross-sectional view showing essential parts of the recording head body according to the first embodiment.

Here, explanation will be made on the configuration of the recording head body 200. FIG. 4 is an exploded perspective view showing the recording head body; FIG. 5 is a cross-sectional view showing the recording head body; and FIG. 6 is a cross-sectional view showing essential parts of the recording head body. As shown in FIGS. 4 to 6, a passage-forming substrate 201 constituting the recording head body 200 is formed of, for example, a silicon monocrystalline substrate, either surface of which has an elastic film 202 made of silicon dioxide by thermal oxidation in advance. A plurality of pressure generating chambers 203 are formed in the passage-forming substrate 201 by an isotropically etching the passage-forming substrate 201 at the other surface. For example, pressure generating chambers 203 form two rows in parallel in a width direction on the passage-forming substrate 201 in the present embodiment. A communicating portion 205 is formed outside in a longitudinal direction of the pressure generating chambers 203 in each row. The communicating portion 205 communicates with a reservoir portion disposed in a protective plate which will be described later, thereby constituting a reservoir 204 serving as a common ink chamber for the pressure generating chambers 203. The communicating portion 205 communicates with one end in a longitudinal direction of each of the pressure generating chambers 203 via an ink supply path 206.

The nozzle plate 208 having nozzles 207 bored therein is secured onto an opening side of the passage-forming substrate 201 via an adhesive agent, a thermal fusing film or the like. The nozzle plate 208 is made of, for example, stainless steel (SUS) in the present embodiment.

In contrast, a piezoelectric element 212 is provided on the elastic film 202 formed on the passage-forming substrate 201. The piezoelectric element 212 includes a lower electrode film 209 made of a metallic material such as platinum or iridium, a piezoelectric layer 210 made of, for example, lead zirconate titanate (PZT), and an upper electrode film 211 made of a metallic material such as iridium.

A protective plate 214 having a piezoelectric element holding portion 213 for protecting the piezoelectric element 212 is joined in a region facing the piezoelectric element 212 on the passage-forming substrate 201 having the piezoelectric element 212 formed thereon. The protective plate 214 has a reservoir portion 215. The reservoir portion 215 constitutes the reservoir 204 serving as the common ink chamber for the pressure generating chambers 203 in communication with the communicating portion 205 at the passage-forming substrate 201, as described above.

Driving ICs 216 for driving the piezoelectric elements 212 are mounted on the protective plate 214. A terminal of each driving IC 216 is connected to a lead electrode drawn from an individual electrode of each piezoelectric element 212 via a bonding wire, although not shown. Furthermore, the terminal of each driving IC 216 is connected to an external wiring 217 such as a flexible printed cable (abbreviated as "FPC"), as shown in FIG. 1. Various kinds of signals including a printing signal are designed to be supplied via the external wiring 217.

A compliance substrate 218 made of, for example, a stainless material (e.g., SUS) is joined in a region corresponding to the reservoir 204 on the protective plate 214. A flexible portion 219 thinner than other regions is disposed on the compliance substrate 218 at a region corresponding to the reservoir 204. Therefore, the flexible portion 219 is deformed to absorb a change in pressure inside of the reservoir 204. Moreover, ink introducing orifices 220 communicating with the reservoir 204 are formed in the compliance substrate 218.

A head case 222 made of, for example, a stainless material (e.g., SUS) is joined on the compliance substrate 218. The head case 222 has an ink supply/communicating path 221 communicating with both of the ink introducing orifice 220 and the ink communicating path 102 formed in the cartridge case 100. In this manner, ink can be supplied into the reservoir 204 through the ink communicating path 102, the ink supply/communicating path 221 and the ink introducing orifice 220. Moreover, a driving IC holding portion 223 penetrating in a thickness direction is disposed in the head case 222 at a region corresponding to the driving IC 216. Here, the driving IC holding portion 223 is filled with a potting agent in such a manner as to cover the driving ICs 216, although not shown.

After the recording head body 200 is filled with the ink from the reservoir 204 up to the nozzle 207, a voltage is applied to the piezoelectric elements 212 corresponding to the pressure generating chambers 203, respectively, in response to a recording signal output from the driving IC 216, and then, a pressure is applied to the ink reserved inside of the pressure generating chambers 203 by flexibly deforming the elastic film 202 and the piezoelectric element 212, thereby ejecting an ink droplet from the nozzle 207.

The plurality of recording head bodies 200 configured as described above, specifically the four recording head bodies 200 in the present embodiment, are adhesively secured to the fixing plate 300 in the state positioned with respect to one another at predetermined intervals (see FIG. 6). An opening portion 301 for exposing the nozzle 207 to the outside is formed at the fixing plate 300 in a manner corresponding to, for example, each of the recording head bodies 200. In other words, a beam portion 302 is disposed in the fixing plate 300 at a region corresponding to a clearance defined between the recording head bodies 200, so that the opening portion 301 is formed in a manner corresponding to each of the recording head bodies 200. To the fixing plate 300 having the above-described beam portions 302, a circumferential edge of each of the recording head bodies 200 on the side of the nozzle plate 208 is joined via an adhesive agent 350. Here, the beam portion 302 in the fixing plate 300 plays a role in preventing any intrusion of the ink into the clearance defined between the recording head bodies 200 in an ink ejection direction, and further, is equipped with a function of securing an adhesion region in bonding the recording head body 200 to the fixing plate 300 with the application of the adhesive agent 350 over the entire circumference of the nozzle plate 208 in the recording head body 200.

A bent portion 303, which is bent toward the recording head body 200, is disposed at the peripheral edge of the fixing plate 300. That is, the fixing plate 300 in the present embodiment is opened at one surface thereof to be thus formed into a substantially box-like shape, and further, includes a recess portion 304 defined by the bent portion 303 serving as a side wall (see FIG. 1). In this manner, the nozzle plate 208 of each recording head body 200 is adhesively secured to the bottom of the recess portion 304.

A reinforcing portion 230 made of a predetermined adhesive agent is disposed at a clearance defined between the recording head bodies 200 which are bonded to the fixing plate 300 at predetermined intervals. The reinforcing portion 230 is continuously disposed at the circumferential edge of the fixing plate 300 in the present embodiment. Specifically, the reinforcing portion 230 is continuously disposed also at a clearance defined between the bent portion 303 of the fixing plate 300 and each of the recording head bodies 200. In other words, each recording head body 200 is positionally bonded to the fixing plate 300, and then, the recess portion 304 of the fixing plate 300 is filled with the predetermined adhesive agent, followed by setting, thereby forming the reinforcing portion 230.

The reinforcing portion 230 formed as described above can substantially enhance the rigidity of the fixing plate 300, and further, can prevent any deformation of the fixing plate 300 in contact with other members at the time of, for example, a sucking operation, which is described later in detail.

Although a type of adhesive agent forming the reinforcing portion 230 is not particularly limited, it is preferable to use an adhesive agent having a higher viscosity and a higher fluidity in an unset state and a lower hardness in an unset state than those of the adhesive agent 350 for use in bonding the recording head body 200 (i.e., the nozzle plate 208) to the fixing plate 300. In the present embodiment, for example, an epoxy-based adhesive agent is used as the adhesive agent 350 for use in bonding the recording head body 200 to the fixing plate 300, whereas a silicone-based adhesive agent is used as the adhesive agent forming the reinforcing portion 230.

In this way, if the adhesive agent forming the reinforcing portion 230 has a relatively low viscosity in the unset state, the adhesive agent can securely flow into the clearance defined between the recording head bodies 200 even at the narrow clearance defined between the recording head bodies 200, thereby satisfactorily forming the reinforcing portion 230. Moreover, the use of the adhesive agent forming the reinforcing portion 230 having a relatively low hardness in the set state can prevent any deformation of the fixing plate 300 accompanied with the setting contraction of the adhesive agent. In other words, since the adhesive agent having the low hardness in the set state is merely slightly contracted accompanied with the setting, the deformation of the fixing plate 300 accompanied with the contraction of the adhesive agent can be greatly suppressed to a low level by forming the reinforcing portion 230 with the above-described adhesive agent.

Incidentally, although a material for the fixing plate 300 serving as a fixing member is not particularly limited, it is preferable to use a material having a linear expansivity equal to or lower than that of the portion of the recording head body 200 to be bonded to the fixing plate 300, that is, that of the nozzle plate 208. For example, the material for the fixing plate 300 is stainless steel (SUS) which is the same as that for the nozzle plate 208 in the present embodiment.

As shown in FIGS. 1 and 2, the cover head 400 for protecting the plurality of recording head bodies 200 from ink and the like is disposed around the plurality of recording head bodies 200 fixed to the fixing plate 300 in the above-described manner. Although the cover head 400 includes a plurality of exposing opening portions 401 for exposing the recording head bodies 200, respectively, in the present embodiment, it is to be understood that the cover head 400 should include only one exposing opening portion for exposing the plurality of recording head bodies 200.

The cover head 400 is secured to the cartridge case 100 having the recording head bodies 200 fixed thereto in the present embodiment. More particularly, as shown in FIGS. 2 and 3, the cover head 400 includes a flange portion 403 at an end on the side of the recording head body 200, and further, a fixing hole 404 penetrating the flange portion 403 is formed in the flange portion 403. In the meantime, a projection 104 is formed on a surface of the cartridge case 100 on the side of the recording head body 200 at a position corresponding to the fixing hole 404 formed in the cover head 400. The projection 104 formed at the cartridge case 100 is inserted into the fixing hole 404 formed in the cover head 400, and then, the tip of the projection 104 is caulked with the application of heat, so that the cover head 400 is secured to the cartridge case 100.

Figure 7:
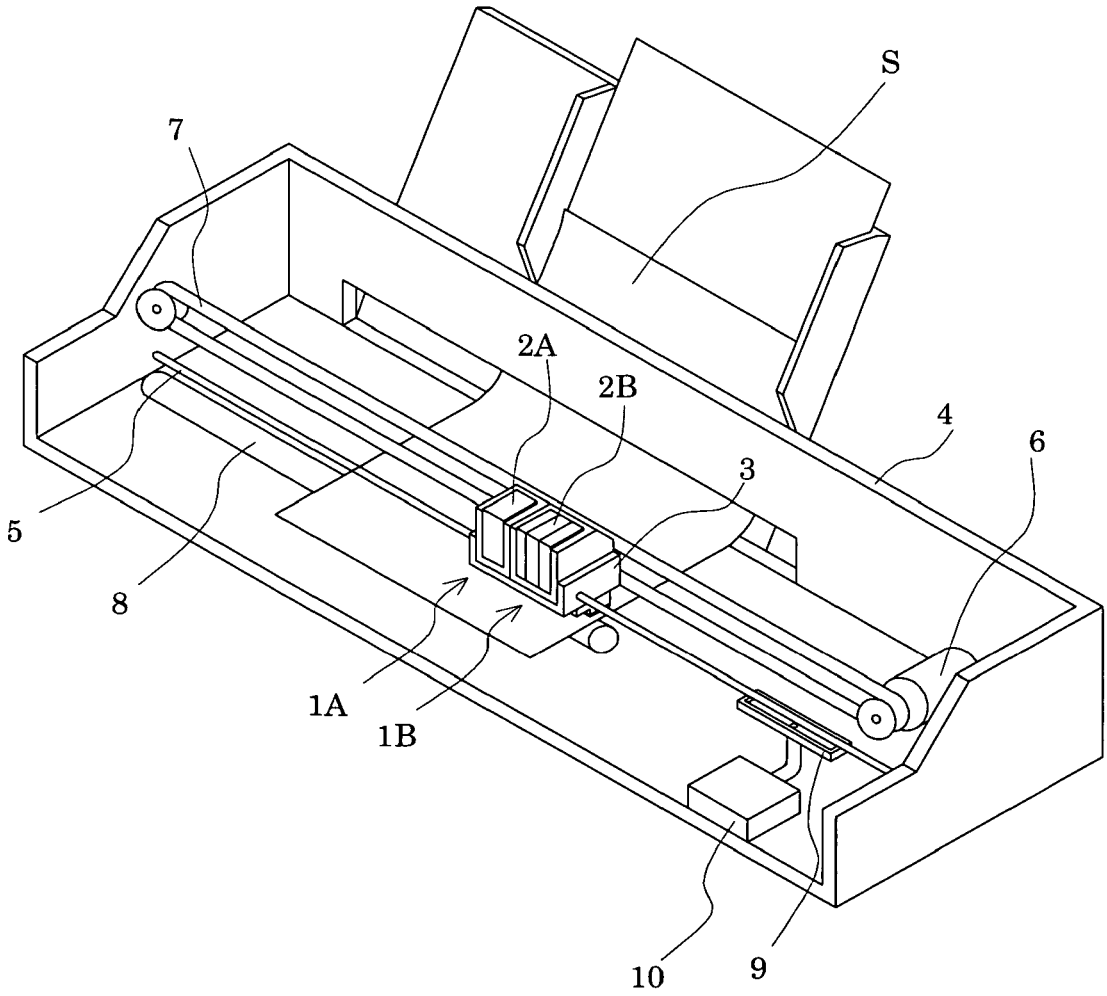
FIG. 7 is a perspective view schematically showing a recording apparatus according to the first embodiment.

The recording head 1 having the configuration is installed in an ink-jet recording apparatus. FIG. 7 is a schematic view showing one example of the ink-jet recording apparatus. As shown in FIG. 7, recording heads 1A and 1B, each having a recording head body, detachably include cartridges 2A and 2B constituting ink suppliers, respectively, and thus, are mounted on a carriage 3. The carriage 3 having the recording heads 1A and 1B mounted thereon is disposed in a carriage shaft 5 attached to an apparatus body 4 in such a manner as to be movable in an axial direction. When a driving force of a driving motor 6 is transmitted to the carriage 3 via a plurality of gears (not shown) and a timing belt 7, the carriage 3 having the recording heads 1 mounted thereon is moved along the carriage shaft 5. In the meantime, the apparatus body 4 includes a platen 8 disposed along the carriage shaft 5. A recording sheet S serving as a recording medium such as paper supplied by a sheet supplying roller and the like (not shown) is designed to be fed on the platen 8.

A capping member 9 for sealing a nozzle surface, to which the nozzles of the recording heads 1A and 1B are opened, and a sucking member 10 for sucking the inside of the capping member 9 in connection to the capping member 9 are disposed at a position corresponding to a home position of the carriage 3, that is, in the vicinity of one end of the carriage shaft 5. The capping member 9 may seal the nozzle surfaces of the recording heads 1A and 1B so as to prevent the ink in the vicinity of the nozzles 207 of the recording heads 1A and 1B from being dried. In addition, the capping member 9 may function as an ink receiver during, for example, a flashing operation for ejecting an ink droplet from the nozzle 207 or a sucking operation when ink or the like is forcibly discharged from the nozzle 207 by sucking the inside of the capping member 9 at a predetermined timing by the sucking member 10.

When the capping member 9 seals the nozzle surfaces of the recording heads 1A and 1B, the fixing plate 300 is deformed together with the cover head 400 in abutment of the capping member 9 against the recording head 1 (the cover head 400), thereby possibly inducing a fear of misalignment of the nozzles 207. In other words, there arises a problem of degradation of accuracy of a landing position of the ink droplet caused by the misalignment of the nozzles 207. However, the reinforcing portion 230 disposed at the clearance between the recording head bodies 200 can substantially enhance the rigidity of the fixing plate 300, so as to prevent any deformation of the fixing plate 300, as described above. As a consequence, it is possible to satisfactorily maintain the accuracy of the landing position of the ink droplet, thus to satisfactorily maintain a print quality for a long period of time. In addition, the reinforcing portion 230 is made of the adhesive agent having the lower hardness in the set state than that of the adhesive agent 350 for bonding each of the recording head bodies 200 and the fixing plate 300 to each other, thereby preventing any deformation of the fixing plate 300 caused by the setting contraction of the adhesive agent forming the reinforcing portion 230. Moreover, the reinforcing portion 230 disposed as described above increases the adhesiveness between each of the recording head bodies 200 and the fixing plate 300, thereby enhancing the durability of the recording head 1.

Additionally, the reinforcing portion 230 substantially enhances the rigidity of the fixing plate 300, thereby preventing any deformation of the fixing plate 300 under the weight of the recording head body 200. As described above, the four recording head bodies 200 are joined to the fixing plate 300 in the present embodiment. Since the fixing plate 300 has a relatively small thickness, there is a fear of deformation also under the weight of the recording head body 200 when the plurality of recording head bodies 200 are secured to the fixing plate 300. However, the reinforcing portion 230 can prevent any deformation of the fixing plate 300 under the weight of the recording head body 200.

In addition, the reinforcing portion 230 is formed by filling the recess portion 304 formed in the fixing plate 300 with the adhesive agent, thereby preventing the ink from remaining in the recess portion 304. That is, if mist of the ink droplet or the like ejected from the nozzle 207 accidentally intrudes and remains in the recess 304, there arises the possible problem of adhesion of the mist to the recording medium such as paper. However, no ink remains in the recess portion 304 since the reinforcing portion 230 is formed in the recess portion 304, thereby preventing any generation of a smear or the like on the recording medium.

Second Embodiment

Figure 8:
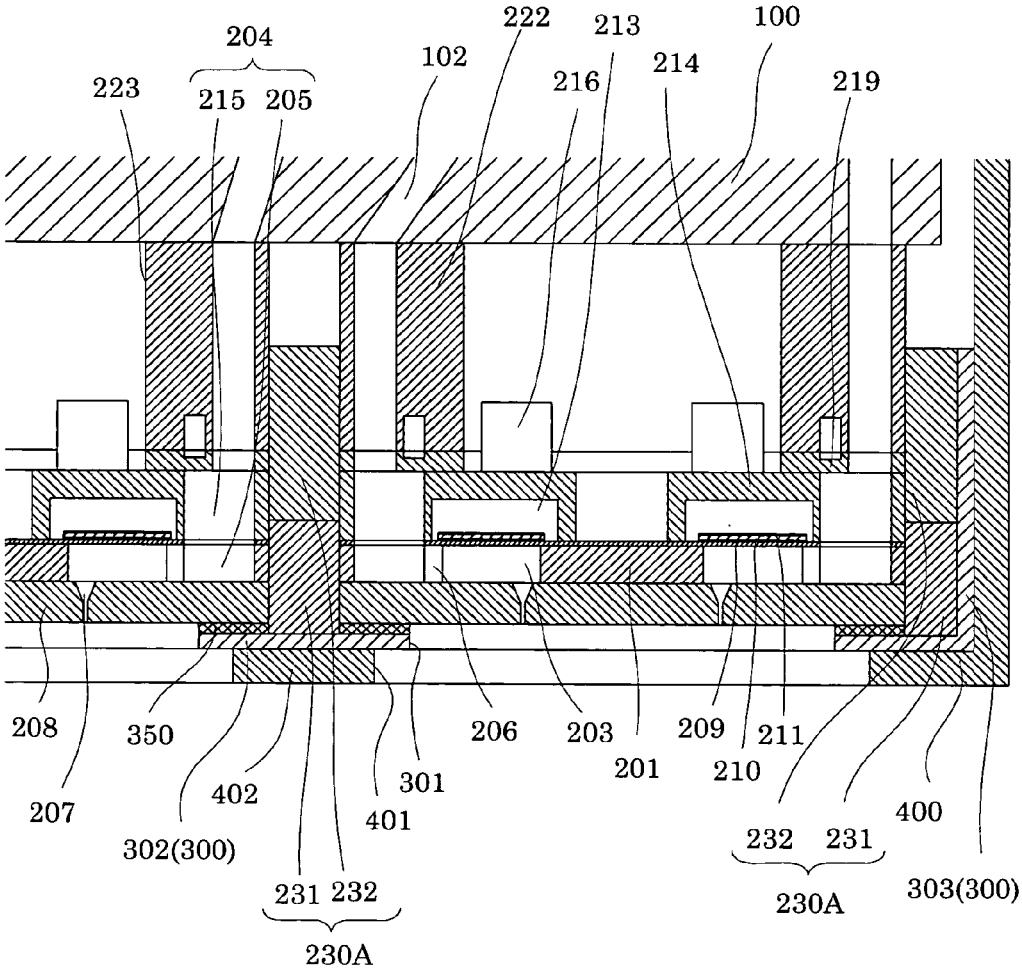
FIG. 8 is a cross-sectional view showing essential parts of a recording head according to a second embodiment.

FIG. 8 is a cross-sectional view showing essential parts of a recording head according to a second embodiment. The configuration in the second embodiment is identical to that in the first embodiment except that the configuration of a reinforcing portion is varied. Specifically, the reinforcing portion 230 in the first embodiment is made of one and the same adhesive agent over the entire region in the thickness direction: in contrast, a reinforcing portion 230A in the second embodiment is constituted of two layers, that is, a first layer 231 and a second layer 232 made of different adhesive agents, as shown in FIG. 8. In the case where the reinforcing portion 230A is constituted of the first layer 231 and the second layer 232, an adhesive agent constituting the first layer 231 formed on a side of a fixing plate 300 is higher in hardness in a set state than an adhesive agent constituting the second layer 232. In other words, the layers constituting the reinforcing portion 230A are made of an adhesive agent having a higher hardness in the set state nearer a nozzle surface of a recording head 1. For example, in the second embodiment, the first layer 231 is made of an epoxy-based adhesive agent, whereas the second layer 232 is made of a silicone-based adhesive agent.

The above-described configuration can securely enhance the rigidity of the fixing plate 300 by the effect of the first layer 231 of the reinforcing portion 230A, thereby preventing any deformation of the fixing plate 300 when a capping member 9 seals the nozzle surface of the recording head 1, as described above. In addition, the second layer 232 is made of the adhesive agent having a relatively lower hardness in the set state, thus effectively preventing any deformation of the fixing plate accompanied with setting contraction of the adhesive agent forming the reinforcing portion 230A.

Although the ratio of the thicknesses of the first layer 231 and the second layer 232 constituting the reinforcing portion 230A is not particularly limited, it is preferable that the first layer 231 should be thinner than the second layer 232. As a consequence, it is possible to more securely prevent any deformation of the fixing plate 300 accompanied with the setting contraction of the adhesive agent forming the reinforcing portion 230A.

If the first layer 231 is formed in excessively great thickness, there occurs the deformation of the fixing plate 300 accompanied with the setting contraction of the adhesive agent, as described above. In view of this, it is desirable that the first layer 231 should be formed as thin as possible to such an extent as to prevent any deformation of the fixing plate 300 caused by the abutment of the capping member 9 against the recording head 1, and that, the first layer 231 should become thinner than at least the second layer 232. In particular, it is preferable that the first layer 231 should be formed in such a thickness as not to be brought into contact with a head case 222, and further, it is preferable that the first layer 231 should be formed in such a thickness as not to be brought into contact with either the head case 222 or a compliance substrate 218 in the second embodiment. As described above, the head case 222 and the compliance substrate 218 are made of, for example, a stainless material (SUS), which is liable to be deformed in comparison with a passage-forming substrate 201 consisting of a silicon substrate. Therefore, if the first layer 231 is brought into contact with the head case 222 or the compliance substrate 218, the head case 222 may be possibly deformed accompanied with the setting contraction of the adhesive agent, thereby inducing a possibility of the deformation of the fixing plate 300 accordingly.

Figure 9A:
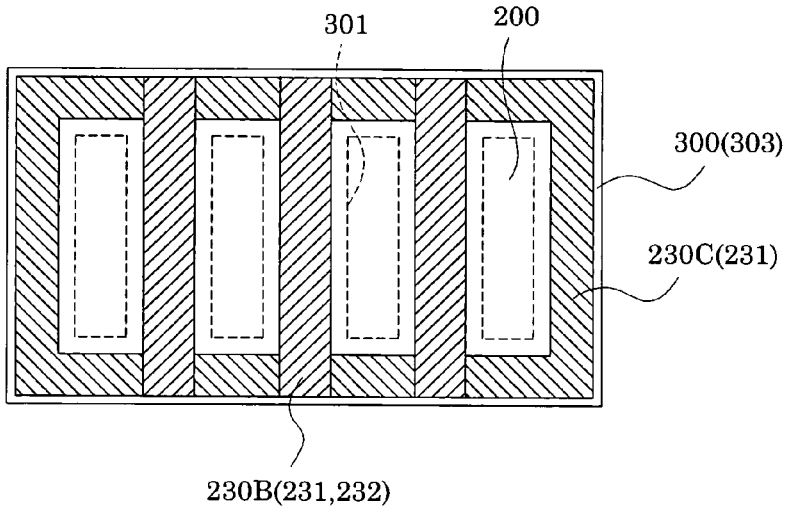
FIG. 9A is a plan view showing a recording head according to a modification of the second embodiment.
Figure 9B:
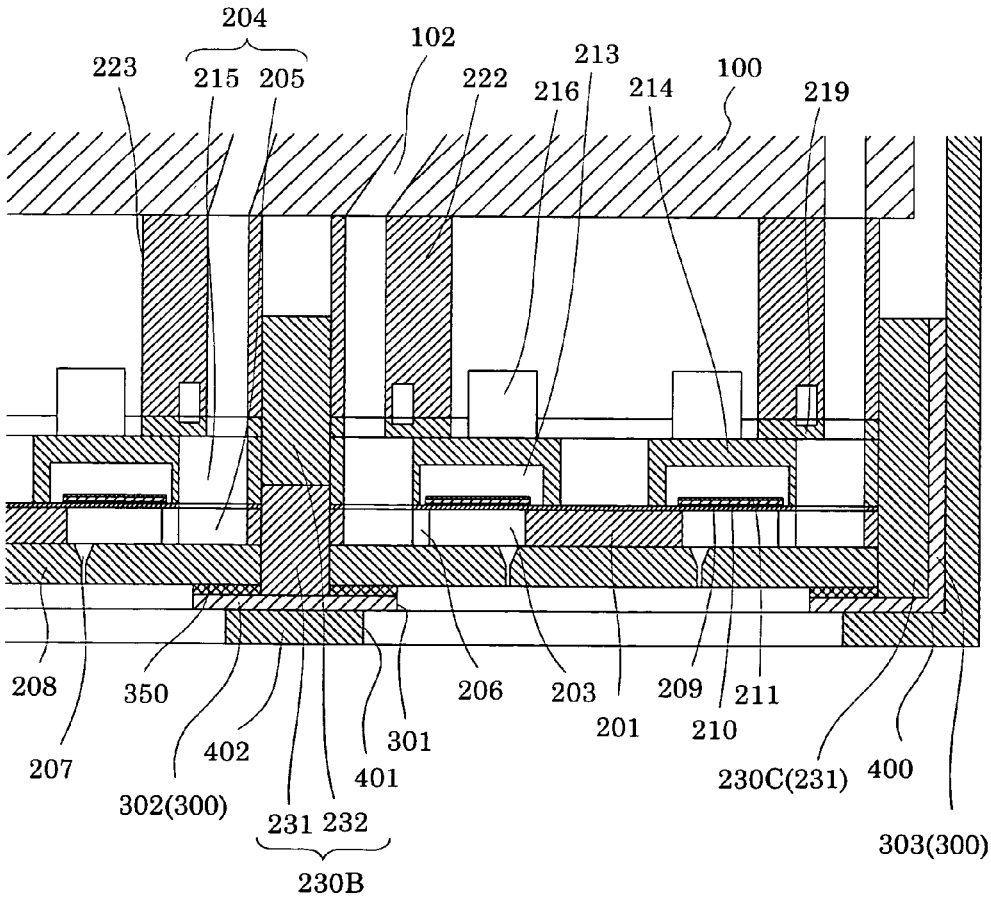
FIG. 9B is a cross-sectional view showing the recording head shown in FIG. 9A.

Although the invention has been described by way of the second embodiment in which all therein forcing portions 230A are formed of a plurality of layers, only a reinforcing portion 230B disposed at a clearance defined between recording head bodies 200 maybe formed of a plurality of layers, as shown in, for example, FIGS. 9A and 9B. Specifically, the reinforcing portion 230B disposed at the clearance defined between the recording head bodies 200 is formed of the above-described first and second layers 231 and 232, and a reinforcing portion 230C disposed at the circumferential edge of the fixing plate 300 is formed of only the first layer 231. As a consequence, the substantial rigidity of the fixing plate 300 can be more securely enhanced. Here, the setting contraction of the adhesive agent constituting the reinforcing portion 230C exerts a relatively small influence at the circumferential edge of the fixing plate 300, so that the fixing plate 300 cannot be substantially deformed even by using an adhesive agent having a high hardness in a set state as the adhesive agent for the reinforcing portion 230C.

Although each of the reinforcing portions 230A and 230B is constituted of the first layer 231 and the second layer 232 in the second embodiment, it is to be understood that the reinforcing portion should be constituted of three or more layers. In this case, the layers constituting each of the reinforcing portions 230A and 230B may be made of an adhesive agent having a higher hardness in a set state nearer the fixing plate 300.

Third Embodiment

Figure 10:
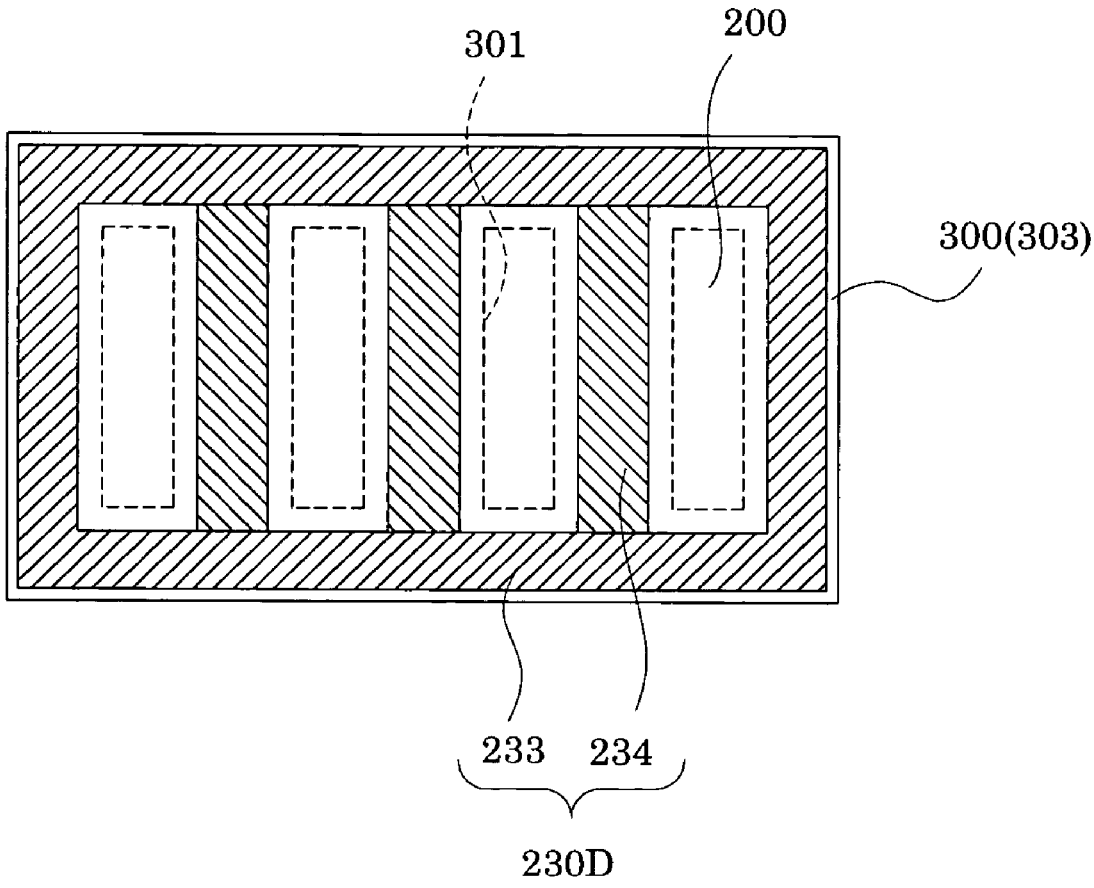
FIG. 10 is a schematic view explanatory of a reinforcing portion forming position according to a third embodiment.

FIG. 10 is a schematic view explanatory of a reinforcing portion forming position according to a third embodiment. The configuration of a reinforcing portion is varied in the present embodiment, in which various adhesive agents are used according to reinforcing portion forming regions. The configuration is identical to that of the first embodiment except for the configuration of the reinforcing portion.

A reinforcing portion 230D according to the third embodiment includes a first reinforcing portion 233 disposed between a bent portion 303 and each of recording head bodies 200, that is, at a circumferential edge of a fixing plate 300 and a second reinforcing portion 234 disposed at a clearance defined between the recording head bodies 200, as shown in FIG. 10. The first reinforcing portion 233 is made of an adhesive agent having a higher hardness in a set state than an adhesive agent forming the second reinforcing portion 234. For example, in the third embodiment, the first reinforcing portion 233 is made of a silicone-based adhesive agent, while the second reinforcing portion 234 is made of an epoxy-based adhesive agent. In the present embodiment, the second reinforcing portion 234 is disposed only between the recording head bodies 200, whereas the first reinforcing portion 233 is continuously disposed at the circumferential edge of the fixing plate 300. However, it is to be understood that the second reinforcing portion 234 should be continuously disposed up to the end of the fixing plate 300, as with the reinforcing portion shown in FIG. 9A.

The reinforcing portion 230D according to the third embodiment can prevent any deformation of the fixing plate 300 caused by the abutment of a capping member 9 against a recording head 1, and further, can prevent any deformation of the fixing plate 300 caused by setting contraction of the adhesive agent forming the reinforcing portion 230D. That is, the first reinforcing portion 233 remarkably enhances the rigidity of the fixing plate 300 at the circumferential edge, against which the capping member 9 abuts, thereby securely preventing any deformation of the fixing plate 300 caused by the abutment of the capping member 9 against the recording head 1. Moreover, the second reinforcing portion 234 disposed at a clearance defined between the recording head bodies 200 is made of an adhesive agent having a relatively lower hardness in the set state, thus effectively preventing any deformation of the fixing plate 300 caused by the setting contraction of the adhesive agent.

Fourth Embodiment

Figure 11:
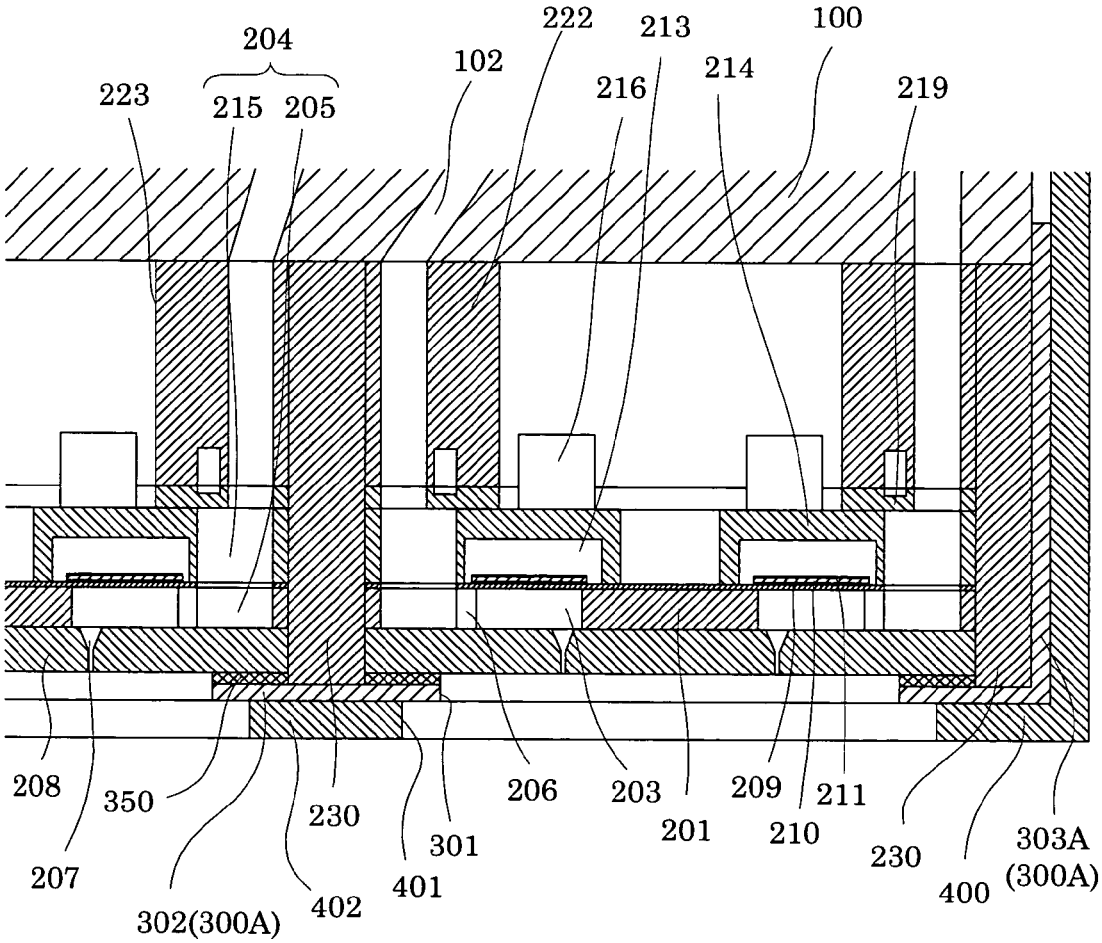
FIG. 11 is a cross-sectional view showing essential parts of a recording head according to a fourth embodiment.
Figure 12:
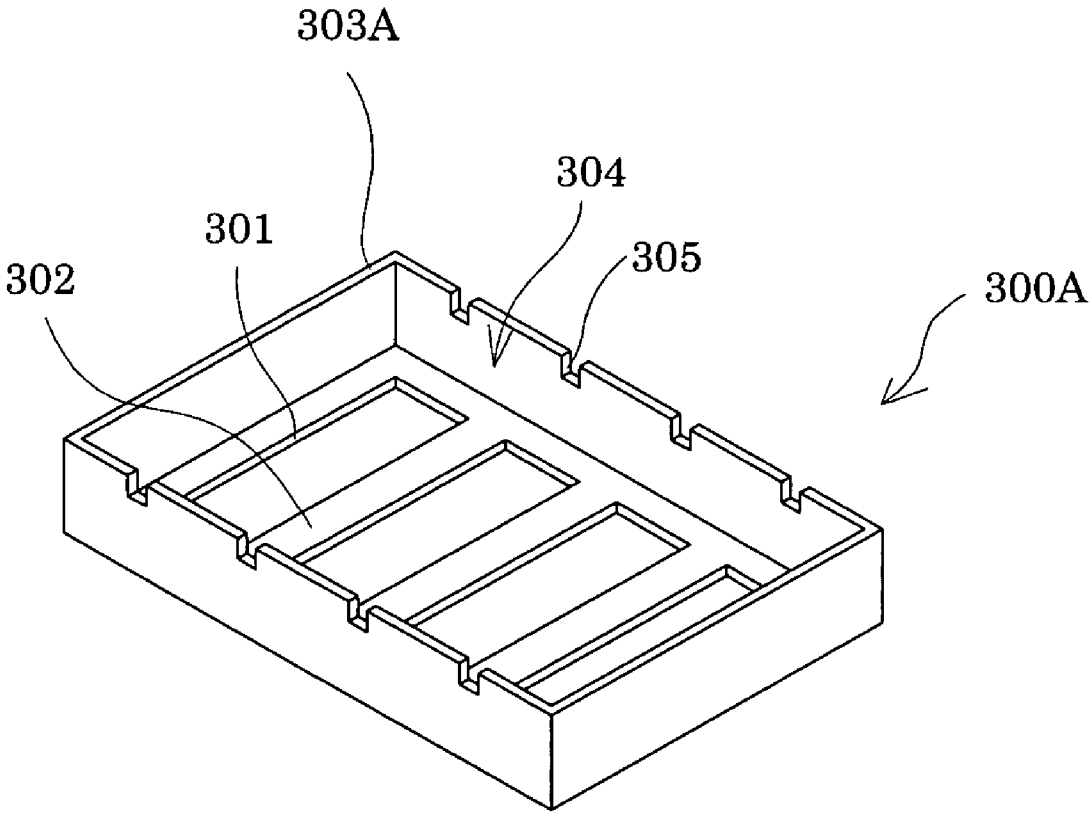
FIG. 12 is a perspective view schematically showing a fixing plate according to the fourth embodiment.

FIG. 11 is a cross-sectional view showing essential parts of a recording head according to a fourth embodiment, and FIG. 12 is a perspective view schematically showing a fixing plate according to the fourth embodiment. The configuration of the fourth embodiment is identical to that in the first embodiment except that the shape of a fixing plate is varied. Specifically, as shown in FIGS. 11 and 12, a bent portion 303A of a fixing plate 300A is formed in height up to a cartridge case 100 in the present embodiment. Cutouts 305 are formed in the bent portion 303A at portions corresponding to both ends in a longitudinal direction of a recording head body 200. The surface (i.e., the end) of the recording head body 200 is exposed inside of the cutout portions 305. A recess portion 304 of the fixing plate 300A is also filled with an adhesive agent, thereby forming a reinforcing portion 230, as in the first embodiment.

The above-described configuration in the fourth embodiment can suppress the deformation of the fixing plate 300A caused by the reinforcing portion 230 when a capping member 9 seals a nozzle surface of the recording head 1, and further, can restrict the deformation of the fixing plate 300A owing to the abutment of the bent portion 303A against the cartridge case. Consequently, it is possible to more securely prevent any deformation of the fixing plate 300A, thus maintaining an excellent print quality for a long period of time.

Additionally, each of the recording head bodies 200 can be positionally secured to the fixing plate 300A with a high degree of accuracy even if the bent portion 303A is formed in height up to the cartridge case 100 since the bent portion 303A includes the cutout portions 305. When each recording head body 200 is positionally secured to the fixing plate 300A, the recording head body 200 is moved while being grasped by a chuck (i.e., a jig). For this reason, if the bent portion 303A is formed in height up to the cartridge case 100, the bent portion 303A interferes with the chuck which grasps the recording head body 200, thereby inducing a possibility that the recording head body 200 cannot be favorably positioned and secured to the fixing plate. However, each recording head body 200 can be favorably positioned, thus to be adhesively secured to the fixing plate 300A if the cutout portions 305 are formed in regions of the bent portion 303A, to which the recording head body 200 is secured, that is, in chuck movement regions, as in the present embodiment.

Fifth Embodiment

Figure 13:
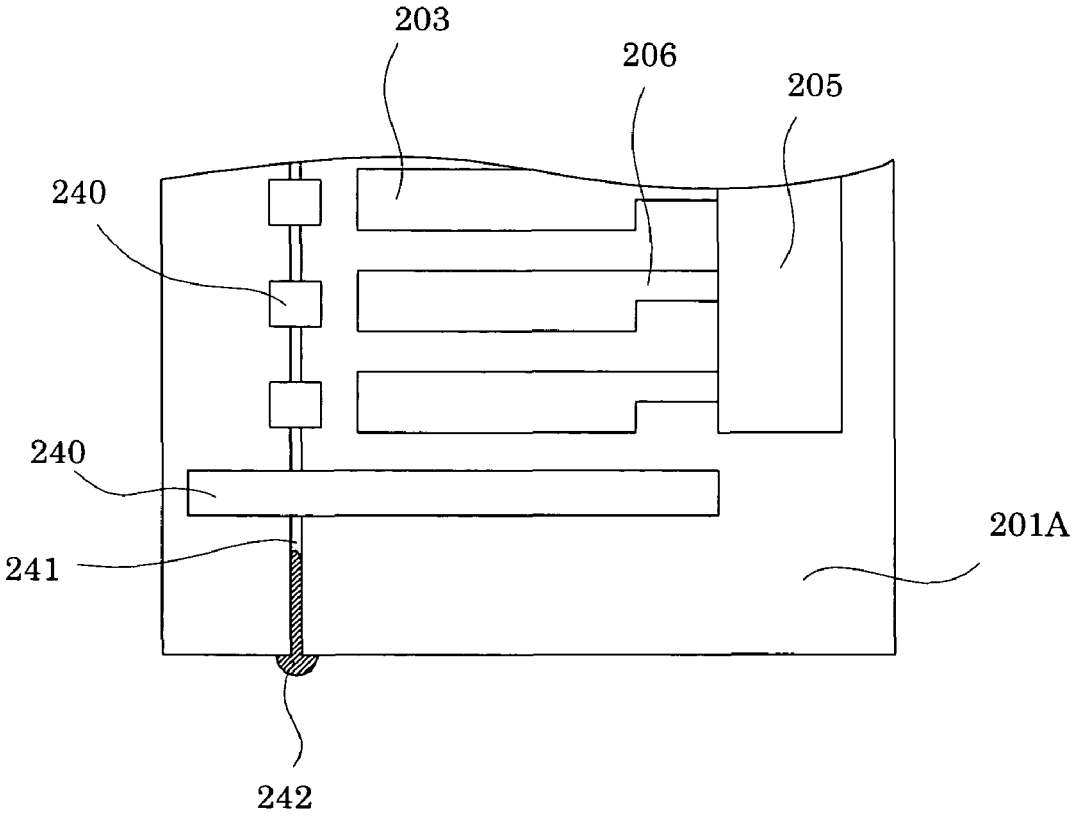
FIG. 13 is a plan view showing a passage-forming substrate according to a fifth embodiment.

FIG. 13 is a plan view showing a passage-forming substrate according to a fifth embodiment. As shown in FIG. 13, relief grooves 240 are formed in a passage-forming substrate 201A in the present embodiment at regions outside of a plurality of pressure generating chambers 203 arranged. Here, the relief groove 240 is adapted to allow an excessive adhesive agent to be relieved when the passage-forming substrate 201A and a nozzle plate 208 are joined to each other via an adhesive agent. In addition, a communicating hole 241 opened at a side end of the passage-forming substrate 201A communicates with the relief groove 240. The relief groove 240 communicates with the outside via the communicating hole 241. The fifth embodiment is identical to the first embodiment except that the opening of the communicating hole 241 is sealed with a sealing member 242 made of an adhesive agent having a lower viscosity in an unset state and a lower hardness in a set state than those of an adhesive agent constituting a reinforcing portion 230.

Specifically, in the fifth embodiment, after the opening of the communicating hole 241 is sealed with the sealing member 242, each recording head body 200 is secured to a fixing plate 300, and then, a recess portion 304 of the fixing plate 300 is filled with the above-described predetermined adhesive agent, thus forming the reinforcing portion 230.

With this configuration, the adhesive agent forming the reinforcing portion 230 intrudes into the relief groove 240 through the communicating hole 241, thereby preventing any cracks, which may be generated in the passage-forming substrate 201A due to the setting of the adhesive agent. As described above, the reinforcing portion 230 is made of the adhesive agent having a relatively low viscosity in the unset state. Therefore, if the reinforcing portion 230 is formed in a state such that the opening of the communicating hole 241 is not sealed, an unset adhesive agent forming the reinforcing portion 230 accidentally intrudes into the relief groove 240 through the communicating hole 241. When the adhesive agent having intruded into the relief groove 240 is set, there arises a possibility that the passage-forming substrate 201A cracks owing to contraction of the adhesive agent during setting. However, as in the fifth embodiment, the opening of the communicating hole 241 is sealed with the sealing member 242, as described above, thereby preventing any intrusion of the adhesive agent into the relief groove 240 even if the adhesive agent serving as the sealing member 242 slightly intrudes into the communicating hole 241. Thus, cracks never occur in the passage-forming substrate 201A in spite of the setting contraction of the adhesive agent.

Other Embodiments

Although the preferred embodiments according to the invention have been described above, the invention is not limited to the above-described embodiments. For example, although the reinforcing portion 230 is disposed around the recording head bodies 200, that is, at the clearances among the recording head bodies 200 and between the recording head body 200 and the bent portion 303 in the above-described embodiments, it is not limited to this. In other words, the reinforcing portion 230 may be disposed at least at the clearance between the recording head bodies 200. Such a configuration can prevent any deformation of the fixing plate 300 caused by the abutment of the capping member 9 against the recording head 1.

Additionally, although the pressure generating element for applying the pressure to the liquid staying inside of the pressure generating chamber is exemplified by a flexible vibration type piezoelectric element in the above-described embodiments, it is not particularly limited to this. For example, the pressure generating element may be a vertical vibration type piezoelectric element, which is obtained by alternately laminating a piezoelectric material and an electrode forming material and is expanded or contracted in an axial direction, or a heat generating element.

Incidentally, although the invention has been described by way of the ink-jet recording head for ejecting the ink droplet in the above-described embodiments, the invention is widely directed to general liquid-jet heads. Examples of the liquid-jet head include a recording head for use in an image recording apparatus such as a printer, a colorant-jet head for use in fabricating a color filter such as a liquid crystal display, an electrode material-jet head for use in forming an electrode for an organic EL display or a field emitting display (FED), and a biologically organic substance-jet head for use in fabricating a biological chip.

What is claimed is:

1. A liquid-jet head, comprising:

a plurality of head bodies, each having:

a nozzle plate having a plurality of nozzles bored therein;

a passage-forming substrate having a pressure generating chamber formed therein, which communicates with the nozzle and receives a pressure for use in ejecting a liquid droplet from a pressure generating element; and a head case disposed on the passage-forming substrate at a surface opposite to the nozzle plate and having paths for supplying liquid to the pressure generating chamber therethrough; and a fixing member bonded onto a side of the nozzle plate of each of the plurality of head bodies, to positionally fix the head bodies thereto at predetermined intervals, wherein a reinforcing portion made of a predetermined adhesive agent, which is charged in a clearance between the head bodies fixed to the fixing member, followed by setting, is disposed at the clearance.

2. A liquid-jet head according to claim 1, wherein the head body is positionally fixed onto a bottom side of a recess portion formed in the fixing member, the adhesive agent is charged in a clearance defined between a side wall of the recess portion and the head body, and the reinforcing portion is disposed also at a circumferential edge of the fixing member.

3. A liquid-jet head according to claim 2, wherein the hardness of the reinforcing portion disposed at the clearance defined between the head bodies is lower than that of the reinforcing portion disposed at the circumferential edge of the fixing member.

4. A liquid-jet head according to claim 2, wherein the reinforcing portion disposed at the clearance defined between the head bodies is constituted of a first layer formed on the side of the fixing member and a second layer formed on the first layer and made of an adhesive agent having a higher hardness in a set state than the adhesive agent constituting the first layer, and further, the reinforcing portion disposed at the circumferential edge of the fixing member is constituted of only the first layer.

5. A liquid-jet head according to claim 2, further comprising a joining member which joins each of the plurality of head bodies thereto and is formed integrally with a plurality of paths corresponding to the head bodies, respectively, on the side of the head case in each of the head bodies, wherein the recess portion formed in the fixing member has a depth reaching the joining member at the tip of the side wall.

6. A liquid-jet head according to claim 5, wherein a pair of cutout portions for exposing a part of each of both ends of the head body are formed on the side wall of the fixing member in a manner corresponding to each of the head bodies.

7. A liquid-jet head according to claim 1, wherein the reinforcing portion is made of an adhesive agent having a lower viscosity in an unset state and a lower hardness in a set state than those of the adhesive agent for use in bonding the fixing member and the head body to each other.

8. A liquid-jet head according to claim 1, wherein the reinforcing portion is constituted of a plurality of layers made of adhesive agents different from one another, and the hardness of the adhesive agent constituting each of the layers in a set state becomes higher toward the fixing member.

9. A liquid-jet head according to claim 8, wherein the reinforcing portion is constituted of a first layer formed on the side of the fixing member and a second layer formed on the first layer and made of an adhesive agent having a higher hardness in a set state than the adhesive agent constituting the first layer, the first layer being thinner than the second layer.

10. A liquid-jet head according to claim 8, wherein the reinforcing portion is constituted of a first layer formed on the side of the fixing member and a second layer formed on the first layer and made of an adhesive agent having a higher hardness in a set state than the adhesive agent constituting the first layer, the first layer being formed in such a thickness as not to be brought into contact with the head case.

11. A liquid-jet head according to claim 1, wherein a relief groove is formed in the passage-forming substrate at a region outside of the pressure generating chamber, the relief groove communicates at one end thereof with the outside via a communicating portion opened at a side surface of the passage-forming substrate, and further, an opening formed at the communicating portion is sealed with a sealing member made of an adhesive agent having a lower viscosity in an unset state and a lower hardness in a set state than those of the adhesive agent constituting the reinforcing portion.

12. A liquid-jet head according to claim 1, further comprising a cover head disposed in such a manner as to cover the nozzle surface, to which the nozzles of the head bodies fixed to the fixing member are opened, the fixing member being a fixing plate interposed between the head body and the cover head.

13. A liquid-jet apparatus, comprising the liquid-jet head according to claim 1.

* * * * *